United States Patent [19]

Koester et al.

[11] Patent Number: 4,475,564

[45] Date of Patent: Oct. 9, 1984

[54] COIN HANDLING APPARATUS

[75] Inventors: Harold E. Koester, Las Vegas; Robert E. Davids, Reno, both of Nev.

[73] Assignee: International Game Technology, Reno, Nev.

[21] Appl. No.: 336,836

[22] Filed: Jan. 4, 1982

[51] Int. Cl.[3] ..... G07D 9/04

[52] U.S. Cl. ..... 133/8 R; 194/1 D

[58] Field of Search ..... 194/1 C, 1 D, DIG. 15, 194/DIG. 28; 133/1 R, 4 R, 4 A, 5 R, 5 A, 8 R, 8 A; 221/7

[56] References Cited

U.S. PATENT DOCUMENTS 2,278,436 4/1942 Friend ..... 194/1 D X 3,108,680 10/1963 Ellis et al. ..... 133/1 R X 3,837,139 9/1974 Roseberg ..... 221/7 X 4,036,242 7/1977 Breitenstein et al. ..... 133/4 R 4,342,384 8/1982 Fukase et al. ..... 133/1 R X

FOREIGN PATENT DOCUMENTS 52-73800 6/1977 Japan ..... 194/1 D

*Primary Examiner*—F. J. Bartuska

*Attorney, Agent, or Firm*—Seiler, Quirk & Tratos

[57] ABSTRACT

An improved coin operated and handling apparatus having a coin acceptor, a hopper payout assembly, coin storage chamber and a coin tray includes a coin diverter assembly located downstream from the hopper payout assembly between the coin storage chamber and coin tray.

8 Claims, 4 Drawing Figures

COIN HANDLING APPARATUS

BACKGROUND OF THE INVENTION

Many coin operated and coin handling machines utilize a coin diverter or deflector to direct coins from a coin acceptor assembly to either a hopper payout assembly or a coin storage chamber, commonly referred to as a drop box. The diverter normally directs coins to the hopper until it is full, after which the diverter directs the coins to the drop box.

Because of the structure of the components of such previous coin operated apparatus, there is required a relatively extended vertical space between the coin entry and the coin tray, the latter being fed by the hopper at the time of payout. By locating the diverter assembly between the hopper and the coin tray according to the present invention, vertical distance of the apparatus for coin handling is reduced, and more accurate coin count in the drop box is achieved. These as well as other advantages will be evident from the following description.

DETAILED DESCRIPTION OF THE INVENTION

Figure 1:
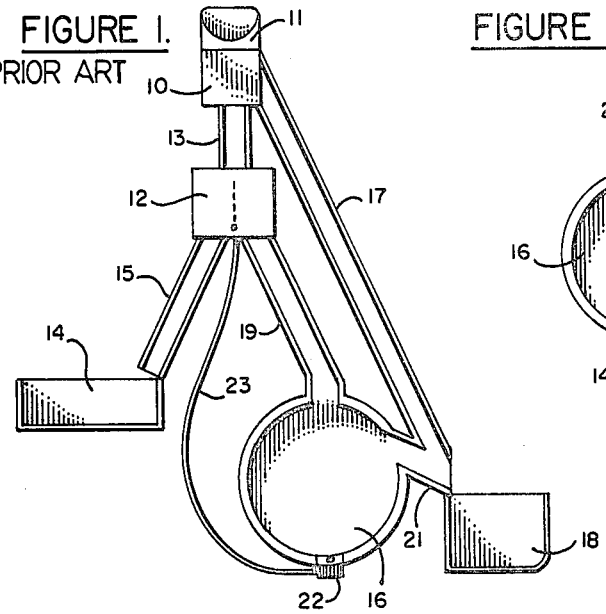
FIGURE 1. PRIOR ART
FIG. 1 is a schematic view of a coin operated and handling apparatus of the prior art.

As shown in FIG. 1, a schematic representation of a typical prior art coin handling apparatus includes a coin entry 11, coin acceptor assembly 10, often referred to as a slug rejector, a coin diverter assembly 12, a coin storage chamber or drop box 14, a hopper payout assembly 16, and a coin tray 18. A switching member 22 detects a full hopper and is electrically connected to diverter assembly 12 by conductor 23 which then causes the diverter to direct coins to the drop box 14 via chute 15 instead of into the hopper via chute 19. Accordingly, once the hopper is full, a coin placed in coin entry 11 travels via chute 13 through coin diverter assembly 12, and into the drop box via chute 15. A slug or unacceptable coin is directed to coin tray 18 via chute 17. When a payout is indicated, a drive mechanism in the hopper payout assembly dispenses coins therefrom into tray 18 via chute 21. Once the hopper payout assembly is unweighted sufficiently, pressure on switch 22 is relieved, and the coin diverter assembly 12 is again signalled to direct further coins to the hopper 16. This, or similar sequence, is repeated during operation of the apparatus.

Figure 2:
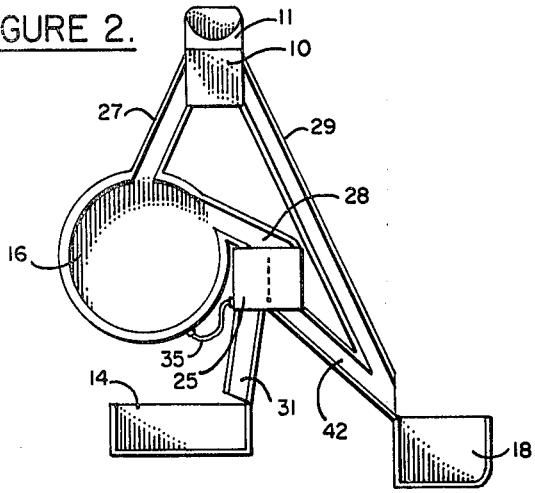
FIG. 2 is a schematic view of an improved coin handling apparatus of the invention.

In the improved apparatus of the present invention, as shown in FIG. 2, the coin diverter assembly 25 is located downstream from the hopper payout assembly 16. Coins entering the diverter assembly are directed either to drop box 14 via chute 31 or coin tray 18 via chute 42. Slugs or other rejected coins are directed from coin acceptor 10 to tray 18 via chute 29. Instead of first being directed to the diverter assembly as in the prior art device, all accepted coins travel first to the hopper via chute 27 from the coin acceptor, and from there, the coins are dispensed to either the drop box or the coin tray. When the hopper becomes full, a drive mechanism in the hopper payout assembly will dispense coins to the diverter assembly 25, and will normally be directed to drop box 14. When a payout is indicated, the hopper payout assembly is driven and the diverter assembly is electrically switched to direct the coins from the hopper to coin tray 18 via chutes 28 and 42. After payout is completed, the diverter assembly is switched back to its normal mode whereby the coins from an overloaded hopper are directed to the drop box. A chute 28 may be used between the hopper and diverter, or, coins may be dispensed directly to the diverter without the necessity of a specific chute. Similarly, drop box 14 may be directly below the diverter to eliminate the use of a chute 31. In a further feature, means may be provided for interrupting the hopper unweighting and to pay a winner or jackpot.

Figure 3:
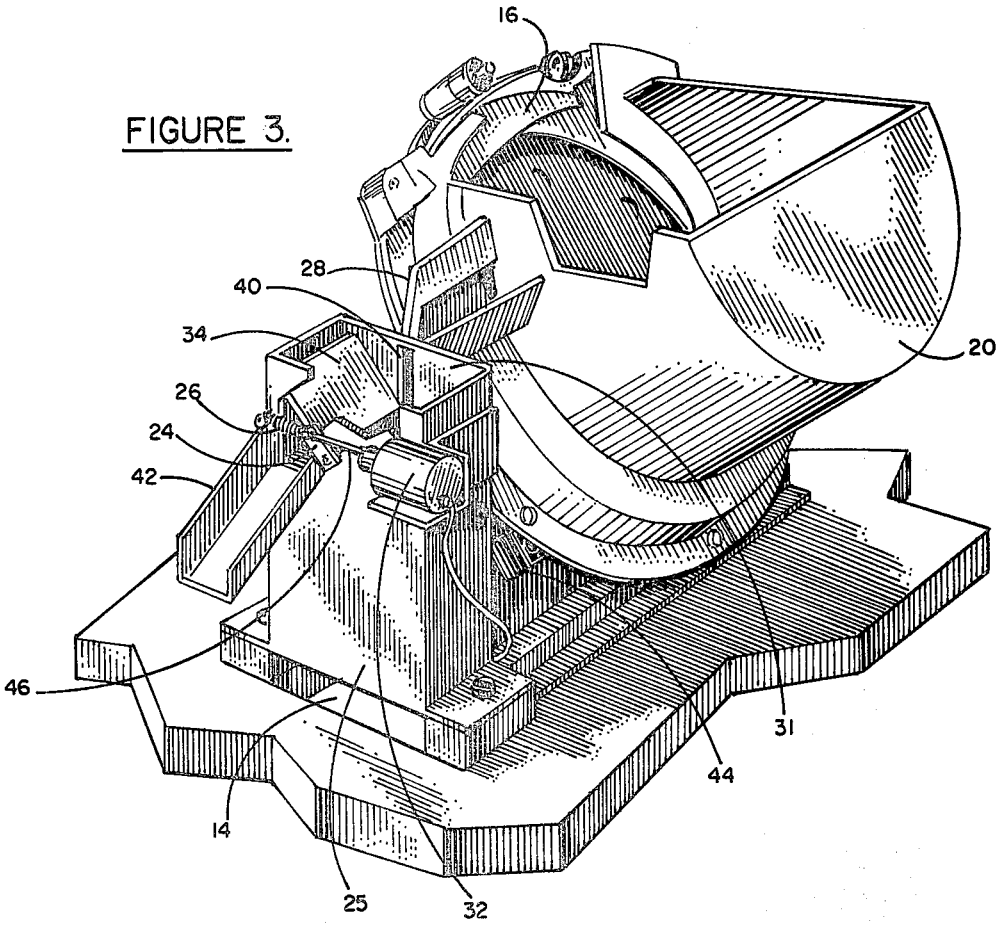
FIG. 3 is a perspective view of a portion of the coin handling apparatus of the invention showing particularly the improved diverter assembly location.
Figure 4:
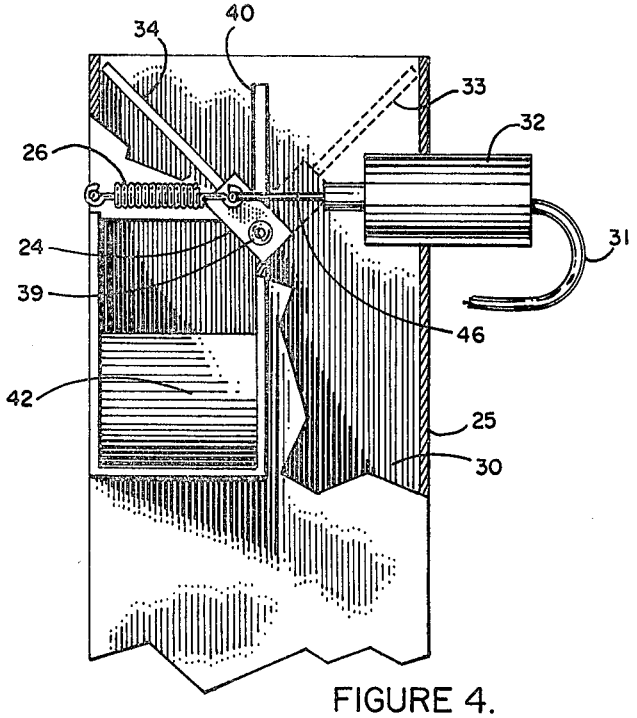
FIG. 4 is a sectional view of the improved coin diverter assembly of the invention.

In FIGS. 3 and 4, the improved apparatus is further viewed. Hopper payout assembly 16 is of the type well known in the art, for example as shown in U.S. Pat. Nos. 3,285,380 and 3,942,544. Such hoppers are by way of example only, and any similar payout assemblies may be used. Since all accepted coins are directed first to the hopper, the coins are collected until such time as a payout is indicated by the apparatus. When sufficient coins have been collected in the coin holding bowl 20 the weight of the coins causes a portion of the assembly to contact microswitch 44 or other similar sensing means for determining overweighting of the hopper payout assembly, and a motor in the assembly is energized to cause dispensing of coins from bowl 20 into diverter 25. The hopper can be driven continuously until it is sufficiently unweighted, or more commonly, will dispense a preset number of coins, in successive sequence, until unweighted. For example, each sequence may dispense 25 coins. Conveniently, the coins pass through chute 28 into port 40 which communicates through back wall 31 of the diverter box. As previously indicated, a specific chute 28 between the hopper and diverter may be eliminated. Moreover, the diverter may be designed so that the back wall is open and port 40 also eliminated. Thus, any suitable diverter design may be used so long as it accomplishes the desired result, and that shown is by way of illustration only.

In a preferred embodiment, diverter plate 34 is normally held in the position shown in FIGS. 3 and 4 by a biasing means such as spring 26 which holds the plate in that position utilizing bracket 24 or similar means. In that position, coins dispensed from the hopper via chute 28 pass into the diverter and drop through the chute 30 (see FIG. 4) into drop box 14. Normally, the drop box is simply directly below the diverter assembly so that an additional chute or passageway is not required.

When a payout condition occurs, an electrical signal energizes both the drive means for the hopper payout assembly and solenoid 32 which retracts plate 34 via arm 46 against the bias of spring 26. Arm 34 is thus moved to position 33 shown in phantom in FIG. 4 and remains in that position so long as solenoid 32 is energized. In that position, coins from the hopper payout assembly, now driven because of the payout condition, are directed via chute 28 into the diverter assembly and pass through port 40 to chute 42, where the coins are directed to a coin tray, readily accessible to the operator. After payout is completed, the electrical signal driving the hopper payout assembly motor or other drive means is terminated as is the signal energizing solenoid 32, which is relaxed, thereby allowing plate 24 to return to its original position because of spring 26.

As previously mentioned, while the hopper payout assembly is dispensing excess coins to the drop box to become unweighted and this sequence is interrupted by a payout condition, solenoid 32 will again be energized, and the payout sequence above mentioned will occur. If payout is not indicated, then the coin simply drops into the hopper.

As previously mentioned, the apparatus of the invention results in substantially reducing the vertical coin drop heretofore required for coin operated machines, for example, slot machines, amusement devices, gaming machines, and the like. By reducing the vertical space requirements, aesthetic designs of such machines may be greatly improved, as well as improving player or operator convenience resulting from the shorter distance between the coin entry slot and the coin payment tray. A further advantage of the apparatus of the invention is that the counting of coins passing into the drop box utilizing the apparatus is improved. Since all coins are counted as they are dispensed from the hopper payout assembly, those which are counted as the hopper is driven for unweighting are the only ones that enter the drop box, and they may now be specifically and independently counted. Of course, coins paid out are also separately counted, and since the payout and unweighting of the hopper payout assembly are independent functions of the apparatus, according to the invention they may be counted independently and individually thereby improving the apparatus. These as well as other advantages within the purview of the invention will be evident to those skilled in the art.

I claim:

1. In a coin operated apparatus having a coin acceptor, a hopper payout assembly including a hopper and hopper drive means, chute means for directing coins from said coin acceptor to said hopper, a coin storage chamber, a coin tray, and chute means for directing rejected coins from said coin acceptor directly to said coin tray, the improvement comprising a coin diverter assembly located for receiving coins from said hopper having a diverter member, first coin directing means communicating said diverter assembly with said coin storage chamber and second coin directing means communicating said diverter assembly with said coin tray, said diverter member normally positioned in a first position wherein said coin storage chamber is in communication with said hopper via said first coin directing means, and movable to a second position wherein said coin tray is in communication with said hopper via said second coin directing means, said hopper payout assembly having sensing means for detecting an overfilled hopper condition whereby said hopper is driven and coins are dispensed therefrom to said coin storage chamber until said overfilled condition is relieved.

2. The apparatus of claim 1 including biasing means for urging said diverter to said first position.

3. The apparatus of claim 1 including payout condition sensing means electrically connected to said diverter means for moving said diverter member to said second position during payout condition.

4. The apparatus of claim 3 including a counting sensor cooperating with said hopper and electrically connected to said diverter means for moving said diverter member to said first position when payout is completed.

5. The apparatus of claim 1 wherein said diverter member comprises a moveable plate for selectively opening and closing said first and second coin directing means.

6. The apparatus of claim 5 including a solenoid for moving said plate and electrically connected to payout condition sensing means.

7. The apparatus of claim 1 including a chute for directing coins from said hopper to said coin diverter assembly.

8. The apparatus of claim 1 wherein said first and second coin directing means comprise chutes.

* * * * *